US006323603B1

(12) United States Patent
Persson

(10) Patent No.: US 6,323,603 B1
(45) Date of Patent: Nov. 27, 2001

(54) RESONANT FLYBACK IGNITOR CIRCUIT FOR A GAS DISCHARGE LAMP CONTROL CIRCUIT

(75) Inventor: Eric G. Persson, Minnetonka, MN (US)

(73) Assignee: Nicollet Technologies Corporation, Minneapolis, MN (US)

( * ) Notice: Subject to any disclaimer, the term of this patent is extended or adjusted under 35 U.S.C. 154(b) by 0 days.

(21) Appl. No.: 09/251,551

(22) Filed: Feb. 17, 1999

Related U.S. Application Data

(60) Provisional application No. 60/075,066, filed on Feb. 18, 1998.

(51) Int. Cl.[7] ..... H05B 37/00

(52) U.S. Cl. ..... 315/290; 315/209 CD; 315/209 R; 315/224; 315/219

(58) Field of Search ..... 315/307, 244, 315/276, 274, 224, 219, 209 R, 209 SC, 194, DIG. 4, 290, 289, 240, 209 T, 207 CD, 204 M, 209 PZ, 209 CS

(56) References Cited

U.S. PATENT DOCUMENTS

| | | | | |
|---|---|---|---|---|
| Re. 29,204 | | 5/1977 | Snyder | 315/106 |
| 3,199,020 | | 8/1965 | Hilker | 323/89 |
| 3,319,154 | | 5/1967 | Rudge | 323/48 |
| 3,676,734 | | 7/1972 | Shimizu et al. | 315/200 |
| 3,679,936 | | 7/1972 | Moerkens | 315/205 |
| 3,699,385 | | 10/1972 | Paget | 315/239 |
| 3,732,460 | | 5/1973 | Wattenbach | 315/123 |
| 3,889,152 | | 6/1975 | Bodine, Jr. et al. | 315/205 |
| 3,922,595 | | 11/1975 | Vieri | 321/47 |
| 4,179,641 | | 12/1979 | Britton | 315/289 |
| 4,286,193 | | 8/1981 | King, Jr. et al. | 315/175 |
| 4,317,068 | * | 2/1982 | Ward et al. | 315/209 CD |
| 4,351,022 | | 9/1982 | Dolland et al. | 363/87 |
| 4,415,837 | * | 11/1983 | Sodini | 315/177 |
| 4,663,569 | | 5/1987 | Alley et al. | 315/175 |
| 4,742,276 | | 5/1988 | Ku | 315/106 |
| 4,795,945 | * | 1/1989 | Mayer | 315/276 |
| 4,900,989 | | 2/1990 | Suenaga et al. | 315/224 |
| 4,912,375 | * | 3/1990 | Deglon et al. | 315/306 |
| 4,959,593 | * | 9/1990 | Joanino | 315/290 |
| 4,980,612 | * | 12/1990 | Gris | 315/240 |
| 5,013,977 | * | 5/1991 | Droho | 315/289 |
| 5,047,694 | * | 9/1991 | Nuckolls et al. | 315/290 |
| 5,083,065 | | 1/1992 | Sakata et al. | 315/307 |
| 5,144,205 | | 9/1992 | Motto et al. | 315/244 |
| 5,166,581 | | 11/1992 | Chermin et al. | 315/289 |
| 5,166,597 | | 11/1992 | Larsen et al. | 323/215 |
| 5,233,273 | | 8/1993 | Waki et al. | 315/224 |
| 5,319,285 | * | 6/1994 | Wang et al. | 315/289 |
| 5,327,047 | | 7/1994 | Gershen | 315/194 |
| 5,331,253 | | 7/1994 | Counts | 315/209 |
| 5,374,875 | | 12/1994 | Shackle et al. | 315/247 |
| 5,406,174 | | 4/1995 | Slegers | 315/219 |
| 5,410,220 | | 4/1995 | von Hertzen | 315/209 R |
| 5,459,377 | * | 10/1995 | Yue | 315/289 |
| 5,469,028 | * | 11/1995 | Nilssen | 315/291 |
| 5,574,338 | * | 11/1996 | Kuusisto et al. | 315/307 |

* cited by examiner

*Primary Examiner*—Don Wong
*Assistant Examiner*—Tuyet T. Vo
(74) *Attorney, Agent, or Firm*—Westman, Champlin & Kelly, P.A.

(57) ABSTRACT

A gas discharge lamp control circuit includes a series circuit formed by first and second AC input terminals, an inductance and first and second lamp terminals. An ignitor circuit is coupled to the series circuit and selectively couples and decouples at least a portion of the inductance in parallel with the first and second AC input terminals to generate a flyback voltage in the inductance.

13 Claims, 6 Drawing Sheets

RESONANT FLYBACK IGNITOR CIRCUIT FOR A GAS DISCHARGE LAMP CONTROL CIRCUIT

CROSS-REFERENCE TO RELATED APPLICATION

This application claims the benefit of U.S. Provisional Application Ser. No. 60/075,066, filed Feb. 18, 1998 and entitled "RESONANT FLYBACK IGNITOR CIRCUIT."

BACKGROUND OF THE INVENTION

The present invention is directed to control circuits for gas discharge lamps. More specifically, the present invention is directed to a resonant flyback ignitor circuit for igniting gas discharge lamps.

Gas discharge lamps are used in a variety of applications. For example, mercury vapor lamps are used for ultraviolet (UV) curing of ink in printing presses, for curing furniture varnish, in germicide equipment for killing germs in food and its packaging, for killing bacteria in medical operating rooms and for lighting applications such as high intensity discharge (HID) lighting. Many other applications also exist.

A traditional circuit for controlling a mercury vapor lamp includes an AC power source which drives a primary side of a ballast transformer. A secondary side of the transformer is coupled to the lamp. The lamp includes a gas-filled tube with electrodes at each end of the tube. The secondary side of the transformer applies a voltage between the electrodes which accelerates electrons in the tube from one electrode toward the other. The electrons collide with gas atoms to produce positive ions and additional electrons. Since the current applied to the gas discharge lamp is alternating, the electrodes reverse polarity each half cycle.

Collisions between the electrons and the gas atoms generate additional electrons. Therefore, an increase in the arc current causes the impedance of the lamp to decrease. This characteristic is known as "negative resistance." The lamp is unstable, and current between the electrodes must be limited to avoid damaging the lamp. As a result, a typical control circuit includes a current limiting inductance coupled in series with the lamp. The inductance can either be a physically separate inductor or "built-in" to the transformer as a leakage inductance.

When the lamp is first started, the lamp requires a very large striking voltage to initiate an arc to ionize the gas in the lamp. The electrodes of the lamp are cold and there are almost no free electrons in the tube. The impedance of the lamp is therefore very high. The voltage required to initiate the arc exceeds that required to sustain the arc. For example, the ignition voltage may be 1,000 volts while the operating voltage may be 100 volts. In such cases, a device known as an ignitor has been added to the ballast transformer.

A typical ignitor circuit superimposes high voltage spikes on the normal output voltage produced by the secondary side of the ballast transformer. These high voltage spikes do not provide significant power themselves, but overcome a potential barrier that would otherwise prevent ionization of the plasma in the lamp during each half-cycle of the AC power being delivered to the lamp.

The high voltage ignitor pulses are typically necessary only during the initial ionization and the warm-up period of the lamp. Once the lamp is at its full operating temperature and power, the ignitor pulses are no longer necessary. Most modern ignitors have timers or are biased such that the ignitors become disabled after a certain time period which is determined to be long enough to fully warm-up the lamp.

In one typical igniter circuit, a resistor-capacitor circuit is coupled to the secondary side of the ballast transformer. Before the lamp ignites, the output voltage of the ballast transformer is sinusoidal like the AC voltage applied to the primary side of the ballast transformer. This voltage appears across the resistor-capacitor network. As the voltage rises, more current passes through the resistor, thereby charging the capacitor. The capacitor continues to charge until the voltage across the capacitor reaches a threshold voltage of a bilateral trigger device. At this point, the bilateral trigger device turns on and applies the capacitor across a small portion of the secondary winding. Through transformer action, the voltage on the capacitor is multiplied by the turns ratio in the winding, and a high voltage appears at the output terminals of the ballast transformer.

Since the energy stored in the capacitor is relatively small, and because the transformer is not designed to support large volt-second values, the igniter output appears as a narrow pulse of high voltage on top of the normal output voltage of the ballast transformer. Each pulse usually lasts only a few microseconds. This type of igniter circuit is typically designed to apply several high voltage pulses per half cycle in order to get the lamp ignited. When the lamp does ignite, the lamp clamps the ballast output voltage to a lower value, which thereby limits the amount of charge supplied to the capacitor. Thereafter, the capacitor never reaches the threshold voltage of the bilateral trigger device. This effectively shuts-off the ignitor after the lamp has ignited.

This type of igniter circuit has several disadvantages for gas discharge control circuits that use modulation or phase control to operate the power delivered to the lamp. These circuits require the lamp current to be reliably initiated. Since the energy per pulse is low in conventional igniter circuits, timely lamp ignition is not ensured. Uncertainty in the ignition timing can result in flickering, instability or loss of control of the lamp current. In addition, several voltage pulses are required in succession for reliable ignition. In order to increase the duration of each igniter pulse to ensure ignition, a different approach would be required along with a larger value storage capacitor. Also, the short, low-energy voltage pulses do not propagate well and are therefore limited to applications in which there is a short distance between the igniter circuit and the lamp. Improved ignitor circuits are therefore desired.

SUMMARY OF THE INVENTION

The gas discharge lamp control circuit of the present invention includes a series circuit formed by first and second AC input terminals, an inductance and first and second lamp terminals. An ignitor circuit is coupled to the series circuit and selectively couples and decouples at least a portion of the inductance in parallel with the first and second AC input terminals.

Another aspect of the present invention relates to a method of igniting a gas discharge lamp. The method includes receiving an AC drive signal through first and second AC inputs and applying the AC drive signal to the gas discharge lamp through an inductance which is in series with the gas discharge lamp. At least a portion of the inductance is coupled in a parallel circuit with the first and second AC inputs to store energy from the AC drive signal in the portion. The portion of the inductance is then decoupled from the parallel circuit to generate a flyback voltage in the inductance.

Yet another aspect of the present invention relates to a gas discharge lamp control circuit which includes first and second AC inputs for receiving an AC drive signal and first and second lamp terminals for coupling to a gas discharge lamp. An inductance is coupled in series between one of the first and second AC inputs and one of the first and second lamp terminals. An ignitor circuit couples at least a portion of the inductance in a parallel circuit with the first and second AC inputs to store energy from the AC drive signal in the portion and then decouples the portion from the parallel circuit to generate a flyback voltage in the inductance.

DETAILED DESCRIPTION OF THE PREFERRED EMBODIMENTS

Figure 1:
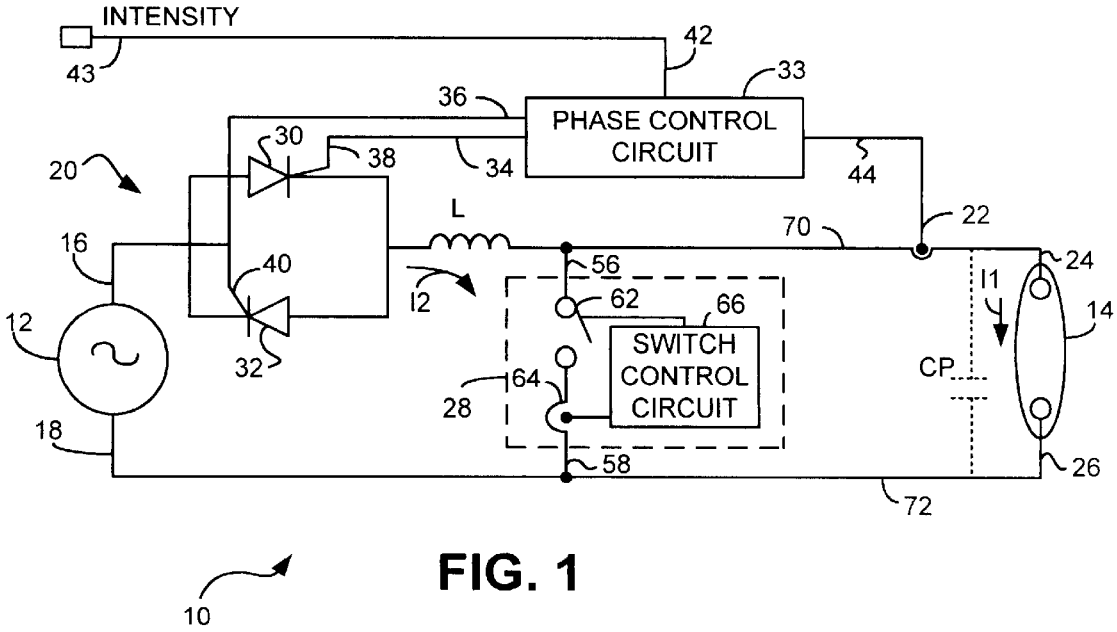
FIG. 1 is a diagram of a gas discharge lamp control circuit having a resonant flyback ignitor circuit according to one embodiment of the present invention.

FIG. 1 is a diagram of a gas discharge lamp control circuit having an ignitor circuit in accordance with one embodiment of the present invention. Control circuit 10 is coupled between alternating-current (AC) source 12 and gas discharge lamp 14. Control circuit 10 includes AC input terminals 16 and 18, silicon controlled rectifier (SCR) circuit 20, current-limiting inductor L, current sensor 22, lamp terminals 24 and 26 and resonant flyback igniter circuit 28. As described in more detail below, ignitor circuit 28 selectively couples inductor L in a parallel circuit with AC input terminals 16 and 18 and then decouples inductor L from the parallel circuit to generate a flyback voltage in the inductor which assists in igniting lamp 14.

AC source 12, inductor L, and lamp 14 are connected together in series to form a main current loop for driving lamp 14. AC source 12 provides an AC drive signal, such as a utility line voltage, which has a plurality of sequential positive and negative half cycles. The AC drive signal can have a frequency such as 60 Hz. SCR circuit 20 controls the average power that is delivered to lamp 14 through inductor L. SCR circuit 20 includes a pair of anti-parallel connected SCRs 30 and 32 which are coupled in series with inductor L. SCR 30 conducts current of the AC drive signal in a positive direction, and SCR 32 conducts current of the AC drive signal in the negative direction.

SCR circuit 20 is controlled by phase control circuit 33. Phase control circuit 33 includes outputs 34 and 36 which are coupled to gates 38 and 40 of SCRs 30 and 32, respectively for independently controlling the turn-on times of each SCR during the positive and negative half cycles in the AC drive signal. Phase control circuit 33 has an intensity control input 42 which is coupled to user input 43, and a current feedback input 44 which is coupled to current sensor 22.

During operation, phase control circuit 33 receives a lamp intensity control signal on input 42 and responsively provides trigger signals on outputs 34 and 36 to trigger SCRs 30 and 32 at the appropriate times within the positive and negative half cycles to control a desired overall current delivered to lamp 14. SCRs 30 and 32 essentially block portions of the line input voltage while allowing other portions to pass. The ratio of passing to blocking determines how much power is delivered to lamp 14. Phase control circuit 33 compares the actual lamp current I1, as measured by current sensor 22, with the desired current provided to intensity control input 42 and drives SCRs 30 and 32 with the appropriate phase angles. Current sensor 22 can include a conventional current transformer, a Hall-effect transducer, a resistive element with an appropriate amplifier circuit or any other type of current measuring transducer.

User input 43 can include a user interface such as a potentiometer, a DIP switch or a keyboard, or can include a programmed computer for automatic intensity control, for example. The computer can be used to ramp the lamp current down from a start level at ionization to a run level following ionization. The current profile of the ramp can be selected to optimize a lamp warm-up period and to maximize lamp life, for example.

Phase control circuit 33 also balances the current delivered to lamp 14 between the positive and negative half cycles of the AC drive signal. Phase control circuit 33 integrates the actual current I1 over time and, after each half cycle, adjusts the phase of the trigger signal applied to one of the SCRs 30 and 32 relative to the phase of the trigger signal applied to the other SCR to force the integral of the current delivered through lamp 14 to zero. This process continues on a cycle-by-cycle basis, where phase control circuit 33 keeps track of the net imbalance in current delivered through lamp 14.

Because of the non-linear nature of high intensity gas discharge lamps, it has been found that conventional phase control does not work well without a capacitor coupled in series with the lamp. Any slight DC imbalance in the current delivered to the lamp causes the entire current-voltage (I-V) operating curve of the lamp to shift, so that the breakdown voltage of the lamp is no longer symmetrical in the positive and negative directions. The lamp becomes a rectifier, with a low breakdown voltage in one direction and a very high breakdown voltage in the other direction. Since conventional phase control provides symmetrical voltage on each half cycle of the current source, only one half cycle will actually conduct through the lamp and the other half cycle will not, resulting in a net DC current component delivered to the lamp.

This half-wave DC mode results in numerous problems, like gas migration in the lamp, lower effective lamp power and transformer saturation problems in the power distribution network. Although a capacitor may be used in series with the lamp to block DC current components, these capacitors are typically expensive and unreliable. Phase control circuit 33 shown in FIG. 1 avoids the need for a series capacitor by independently adjusting the phase angle for each half cycle to cancel any net DC current component delivered to the lamp.

Phase control circuit 33 can include analog control elements, digital control elements or a combination of both for generating the trigger pulses at the appropriate times as a function of the desired intensity and the actual current delivered through lamp 14. An example of a suitable phase control circuit is disclosed in U.S. Pat. No. 5,578,908, issued Nov. 26, 1996 and entitled "PHASE CONTROL CIRCUIT HAVING INDEPENDENT HALF CYCLES," which is hereby incorporated by reference. A suitable phase control circuit is also available from Nicollet Technologies Corporation, Minneapolis, Minn. 55413, under the trademark ELECTRONIC BALLAST SYSTEMS.

In alternative embodiments of the present invention, no phase control is used. In these embodiments, phase control circuit 33 and SCR circuit 20 are removed, and a capacitor is placed in series with lamp 14.

When lamp 14 is first started, the lamp requires a very large striking voltage to initiate an arc to ionize the gas in the lamp. The electrodes of the lamp are cold and there are almost no free electrons in the tube. The impedance of the lamp is therefore very high, and the lamp appears as an open circuit. The voltage required to initiate the arc exceeds that required to sustain the arc. For example, the ignition voltage may be 1,000 volts while the operating voltage may be 100 volts.

Resonant flyback ignitor circuit 28 is coupled across the series circuit formed by AC source 12, inductor L and lamp 14 for selectively coupling inductor L in a parallel circuit with AC input terminals 16 and 18. This allows energy from the AC drive signal to be stored in inductor L when lamp 14 is out. When ignitor circuit 28 decouples inductor L from the parallel circuit, a flyback voltage is generated in inductor L to maintain the current that was flowing through the inductor before the inductor was decoupled. This flyback voltage is added to the normal AC drive signal and transferred to lamp 14 as a high voltage pulse. The high voltage pulse has an amplitude and duration that are selected based on the circuit parameters to reliably ignite lamp 14. Ignitor circuit 28 includes ignitor switch 62, current sensor 64 and switch control circuit 66.

Ignitor switch 62 is normally open. During each of the positive and negative half cycles of the AC drive signal, switch control circuit 66 temporarily closes ignitor switch 62. In one embodiment, switch control circuit 66 receives the trigger signals provided by phase control circuit 33 on outputs 34 and 36 and closes ignitor switch 62 each time SCR 30 or SCR 32 is turned on.

Closing switch 62 effectively couples inductor L in parallel with AC input terminals 16 and 18 such that all of the AC drive signal is applied across inductor L. Current I2 flows through inductor L, switch 62 and current sensor 64. As current I2 ramps up, switch control circuit 66 compares current I2 with a selected peak current. The peak current is selected so that the flyback voltage reaches a desired magnitude. When current I2 reaches the selected peak current, switch control circuit 66 opens ignitor switch 62. Inductor L is now coupled again in series with lamp 14, which appears as an open circuit.

With the sudden disconnection of inductor L through ignitor switch 62, the voltage across inductor L increases to try to maintain the current I2 that had been flowing through inductor L when igniter switch 62 was opened. This generates the "flyback" voltage. The magnitude of the flyback voltage is directly proportional to the current I2 that was flowing through inductor L just before ignitor switch 62 opened. As a result of the flyback voltage, current I2 rapidly charges a capacitor CP (shown in phantom) across lamp 14. Capacitor CP can include a discrete capacitor or an equivalent parasitic capacitance of lamp wiring 70 and 72. Inductor L, capacitance CP, the resistance of cables 70 and 72 and the resistance of lamp 14 form a series resonant resistor-inductor-capacitor (RLC) circuit, which shapes the flyback voltage pulse.

The flyback voltage pulse is superimposed on the voltage applied to lamp 14 by AC source 12. This provides a striking voltage for igniting lamp 14. The magnitude of the flyback voltage pulse will vary depending upon the design of inductor L, the characteristics of lamp 14, the capacitance and resistance of lamp cables 70 and 72, and the voltage provided by AC source 12. The magnitude of the desired peak current through inductor L before switch 62 is opened is selected to achieve a desired striking voltage across lamp 14. Once lamp 14 ignites, the remainder of the energy stored in inductor L is transferred to lamp 14. This process repeats for each half cycle. On negative half cycles, the polarity of the voltages and currents are reversed.

In one embodiment, ignitor circuit 28 is operated only during the initial lamp ionization and during the warm-up period of the lamp. A timer or other control circuit (not shown) is used to decouple the trigger pulses being applied to switch control circuit 66.

Ignitor circuit 28 has the capability of adjusting the magnitude of the flyback voltage pulse that is applied to lamp 14. Closing ignitor switch 62 stores energy from the AC drive signal on inductor L. The longer switch 62 is closed during each half cycle, the greater the energy stored on inductor L. Opening switch 62 releases the stored energy, resulting in a high striking voltage across lamp 14. Adjusting the length of time during which ignitor switch 62 is closed adjusts the level of energy stored in inductor L and thus the magnitude of the striking voltage.

Ignitor circuit 28 can be coupled across the series circuit formed by AC source 12, inductor L and lamp 14 in a variety of configurations. Several alternative embodiments are shown in FIGS. 2–8. The same reference numerals are used in FIGS. 2–8 as were used in FIG. 1 for the same or similar elements. For simplicity, current sensor 22 and phase control circuit 33 are not shown in FIGS. 2–8.

Figure 2:
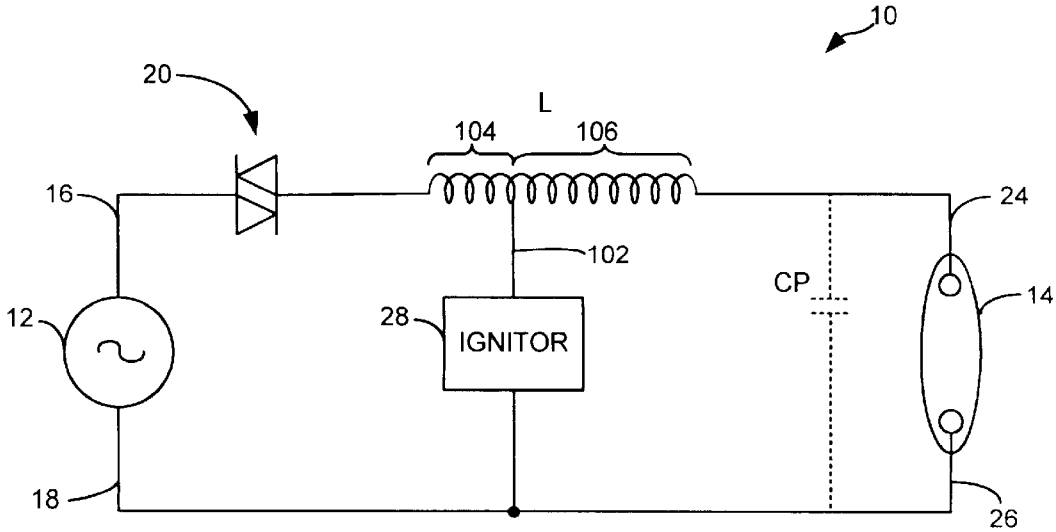
FIG. 2 is a diagram of a gas discharge lamp control circuit according to an alternative embodiment of the present invention.

In FIG. 2, inductor L has a winding with a tap 102 between a first set of turns 104 and a second set of turns 106. Ignitor 28 is coupled between tap 102 and AC input terminal 18. When switch 62 of ignitor 28 is closed, only the first set of turns 104 is coupled in parallel with AC input terminals 16 and 18. This reduces the peak voltage that is applied across igniter 28. The relative number of turns in the first and second sets 104 and 106 can be selected as desired to limit the voltage seen by igniter 28. For example, if tap 102 is coupled to the midpoint of inductor L, the peak voltage seen by igniter 28 in FIG. 2 will be half of that seen by ignitor 28 in FIG. 1. However, the current through ignitor 28 in FIG. 2 will be twice that in FIG. 1 in order to store the same energy in inductor L as in FIG. 1.

Figure 3:
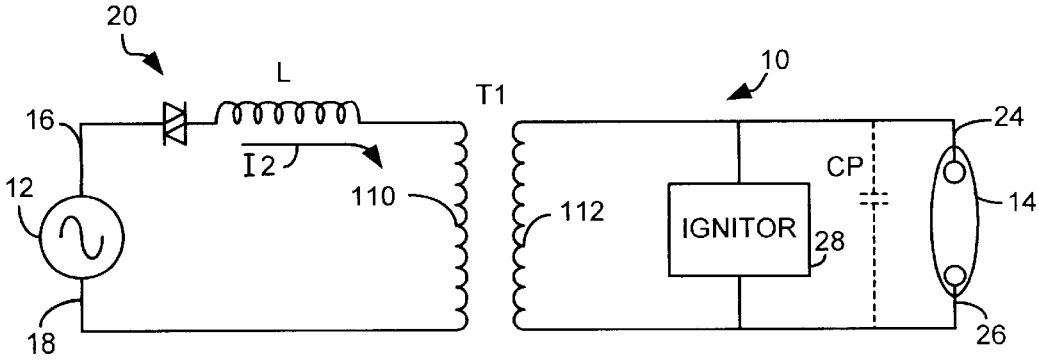
FIG. 3 is a diagram of a gas discharge lamp control circuit according to another alternative embodiment of the present invention.

In FIG. 3, gas discharge control circuit 10 further includes a power ballast transformer T1 between inductor L and ignitor 28. Transformer T1 includes primary winding 110 and secondary winding 112. Primary winding 110 is coupled in series with inductor L across input terminals 16 and 18 for receiving the AC drive signal from AC source 12. Inductor L can be either a physically separate inductor or "built-in" to the power transformer T1 as a primary-referred leakage inductance. Secondary winding 112 is coupled in series with lamp 114. Ignitor 28 is coupled across the entire secondary winding 112.

In the embodiment shown in FIG. 3, transformer T1 can be used to provide voltage scaling (either up or down) if desired. However, circuit 10 operates the same as in FIG. 1 with respect to the operation of ignitor 28 and the flyback voltage generated in inductor L. This can be seen if we assume, for example, that transformer T1 has a primary-to-secondary winding ratio of 1:1. The effective electrical circuit would therefore be the same if transformer T1 were removed.

At the beginning of each half cycle, ignitor 28 short circuits secondary winding 112. As a result, primary winding 110 is seen as a direct short between inductor L and AC input terminal 18. Inductor L is therefore effectively coupled in a parallel circuit with AC input terminals 16 and 18, just as in the embodiment shown in FIG. 1. The increasing current through primary winding 110 results in a corresponding increase in current through secondary winding 112. When the current I2 through inductor L reaches the selected peak value, as measured by the current flowing through ignitor 28, ignitor 28 opens, thereby effectively coupling inductor L back in series with lamp 14. This results in a flyback voltage within inductor L which is transferred to lamp 14 through transformer T1.

In this embodiment, the RLC circuit includes the inductor L (either as a discrete inductor or a leakage inductor within transformer T1), the parasitic capacitance of transformer T1, the parasitic capacitance of the lamp wiring, the resistance of transformer T1 and the resistance of the lamp and its wiring.

Figure 4:
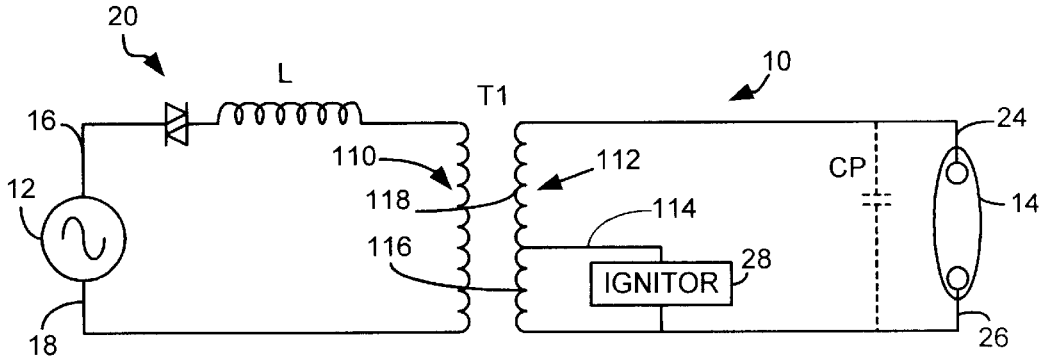
FIG. 4 is a diagram of a gas discharge lamp control circuit according to another alternative embodiment of the present invention.

In FIG. 4, secondary winding has a tap 114 between a first set of turns 116 and a second set of turns 118. Ignitor 28 is coupled to tap 114, across only the first set of turns 116 of secondary winding 112. Again, this reduces the peak voltage that is applied across ignitor 28. If transformer T1 is viewed as an ideal transformer, shorting the first set of turns 116 is the same as shorting the entire secondary winding and results in primary winding 110 being viewed as a direct short. Thus, when the switch in ignitor 28 is closed, inductor L is temporarily coupled in parallel with AC input terminals 16 and 18.

Figure 5:
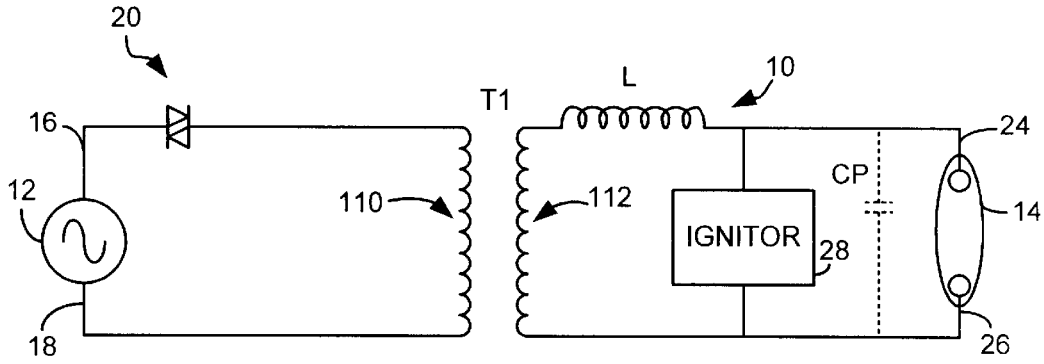
FIG. 5 is a diagram of a gas discharge lamp control circuit according to another alternative embodiment of the present invention.

In FIG. 5, inductor L is moved to the secondary side of transformer T1. Inductor L can include a discrete inductor or can be "built-in" to transformer T1 as a secondary-referred leakage inductance. Ignitor 28 is coupled across the entire secondary winding 112 and the entire inductor L. Closing ignitor 28 couples inductor L in parallel with secondary winding 112. Since transformer T1 merely provides voltage scaling, inductor L is effectively coupled in parallel with AC input terminals 16 and 18.

Figure 6:
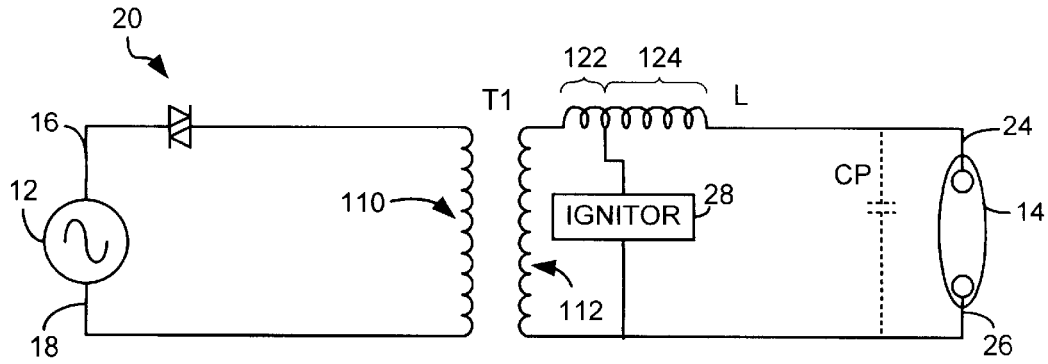
FIG. 6 is a diagram of a gas discharge lamp control circuit according to another alternative embodiment of the present invention.

In FIG. 6, ignitor 28 is coupled across the entire secondary winding 112, but only a portion of inductor L. Inductor L has a tap 120 between a first set of turns 122 and a second set of turns 124. Ignitor 28 is coupled between tap 120 and the bottom of secondary winding 112. When the switch in igniter 28 is closed, only the first set of turns 122 is coupled in parallel with secondary winding 112 and thus with AC input terminals 16 and 18.

Figure 7:
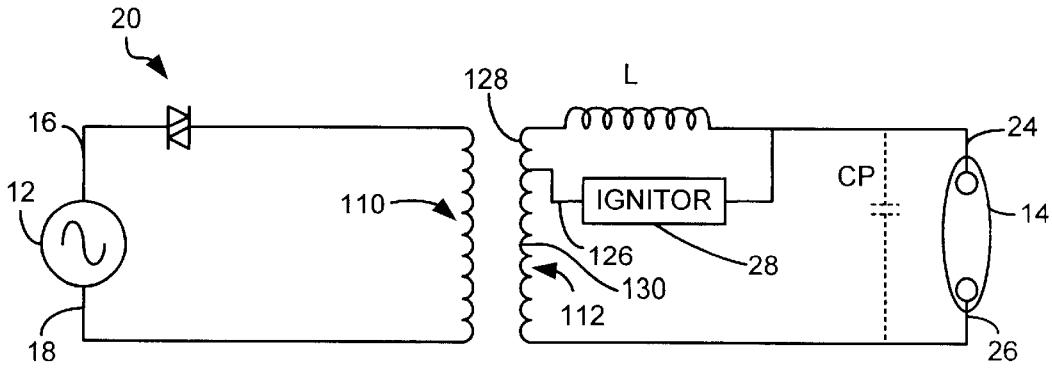
FIG. 7 is a diagram of a gas discharge lamp control circuit according to another alternative embodiment of the present invention.

In FIG. 7, secondary winding 112 has a tap 126 between a first set of turns 128 and a second set of turns 130. Igniter 28 is coupled across the entire inductor L and only the first set of turns 128 of secondary winding 112.

Figure 8:
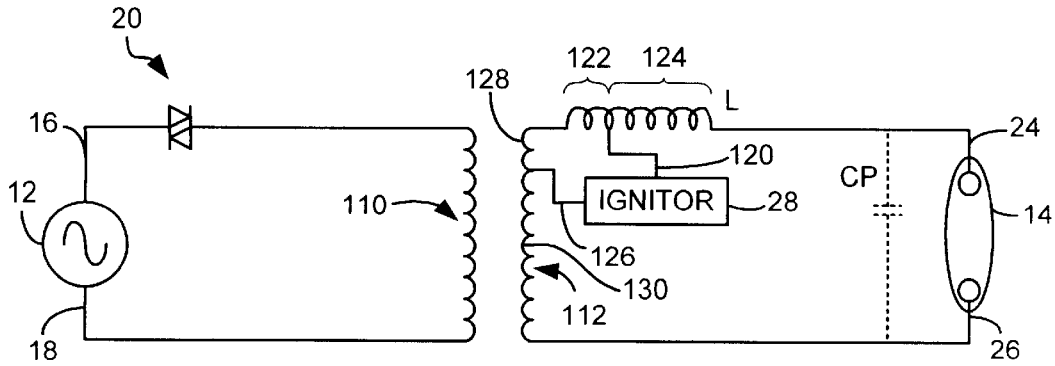
FIG. 8 is a diagram of a gas discharge lamp control circuit according to another alternative embodiment of the present invention.

In FIG. 8, igniter 56 is coupled between tap 120 of inductor L and tap 126 of secondary winding 112. Ignitor 28 is therefore coupled across only the first set of turns 122 of inductor L and the first set of turns 128 of secondary winding 112.

Figure 9:
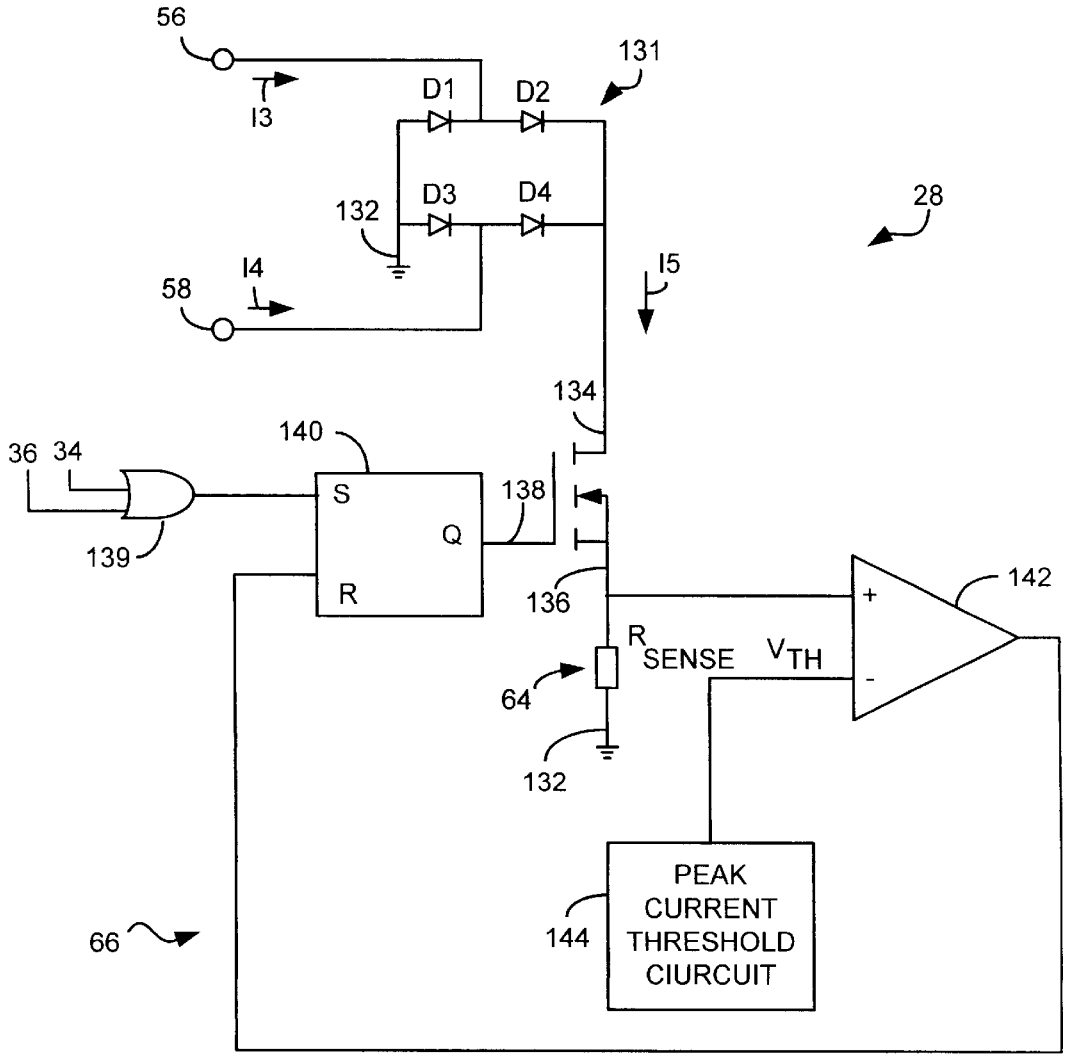
FIG. 9 is a diagram showing the resonant flyback ignitor circuit in greater detail according to one embodiment of the present invention.

FIG. 9 is a diagram showing igniter circuit 28 in greater detail according to one embodiment of the present invention. Ignitor circuit 28 includes inputs 56 and 58, igniter switch 62, current sensor 64, switch control circuit 66 and bridge rectifier 131.

Bridge rectifier 131 rectifies currents I3 and I4 flowing through ignitor terminals 56 and 58 during the positive and negative half cycles, respectively, of the AC drive signal such that currents I3 and I4 pass through igniter switch 62 and current sensor 64 in a single direction as current I5. Bridge rectifier includes diodes D1–D4. Ignitor input 56 is coupled to the cathode of diode D1 and the anode of diode D2. Igniter input 58 is coupled to the cathode of diode D3 and the anode of diode D4. The anodes of diodes D1 and D3 are coupled to local common node 132. The cathodes of diodes D2 and D4 are coupled to ignitor switch 62.

Ignitor switch 62 includes transistor Q1 having main current terminals 134 and 136 and current control terminal 138. Transistor Q1 can include a bipolar junction transistor ("BJT"), a field effect transistor ("FET"), an insulated gate bipolar transistor ("IGBT") or any other suitable switching circuit.

Current sensor 64 includes a resistor $R_{SENSE}$. However, other current sensors can also be used, such as a conventional current transformer, a Hall-effect transducer, or any other type of current measuring transducer. Current sensor 64 is coupled between terminal 136 of transistor Q1 and local common node 132.

Switch control circuit 66 includes a trigger circuit, formed by an OR gate 139 and a reset-set flip-flop 140, a comparator 142 and a peak current threshold circuit 144. The non-inverting input of comparator 142 is coupled to terminal 136 of transistor Q1. The inverting input of comparator 142 is coupled to peak current threshold circuit 144. The output of comparator 142 is coupled to the reset input "R" of flip-flop 140. The set "S" input of flip-flop 140 is coupled to the output of OR gate 139. The inputs of OR gate 139 are coupled to trigger outputs 34 and 36 of phase control circuit 33 (shown in FIG. 1). The output "Q" of flip-flop 140 is coupled to control terminal 138 of transistor Q1.

In alternative embodiments, switch control circuit 66 can include analog components, digital components, a combination of analog and digital components or can be implemented in a programmed computer.

During operation, transistor Q1 is normally off, resulting in an open circuit condition between ignitor inputs 56 and 58. When a trigger pulse is provided on either trigger output 34 or 36, the trigger pulse sets flip-flop 140 causing output "Q" to go active, turning on transistor Q1. This turns on transistor Q1 at the same time as the corresponding SCR 30 or 32 is turned on.

When transistor Q1 is on, transistor Q1 passes current I5 to current sensor 64. The voltage developed across current sensor 64 is applied to the non-inverting input of comparator 142. Peak current threshold circuit 144 provides a threshold voltage $V_{TH}$ to the inverting input of comparator 142, which represents of the desired peak level for current I5. When the voltage developed across current sensor 64 reaches and exceeds threshold voltage $V_{TH}$ , the output of comparator 142 goes active, resetting flip-flop 140. Output "Q" of flip-flop 140 goes inactive, turning off transistor Q1 and preventing current I5 from ramping any further.

Switch control circuit 66 therefore controls the level of energy stored in inductor L (shown in FIG. 1) before transistor Q1 is turned off. Limiting the level of energy stored in inductor L limits the magnitude of the flyback voltage pulse and thus the striking voltage across lamp 14 generated when transistor Q1 is turned off. The magnitude of the striking voltage can be selected by selecting the threshold voltage $V_{TH}$.

The threshold $V_{TH}$ can be preset or can be manually or automatically adjusted. For example, peak current threshold circuit 144 can include an adjustable voltage divider which is controlled through a potentiometer or a series of DIP switches. This allows ignitor 28 to be tuned to the particular application in which ignitor 28 is used. If ignitor 28 is physically separated from lamp 14 by a large distance, the lamp cables will have large parasitic capacitance. This extra capacitance load will reduce the magnitude of the fixed-energy ignitor pulse. By increasing the threshold voltage $V_{TH}$, the effect of the additional capacitance can be compensated, resulting in the correct ignitor pulse magnitude. Correspondingly, the threshold voltage $V_{TH}$ can be reduced for driving very short cables, so as not to deliver too large of an ignitor pulse.

Figure 10:
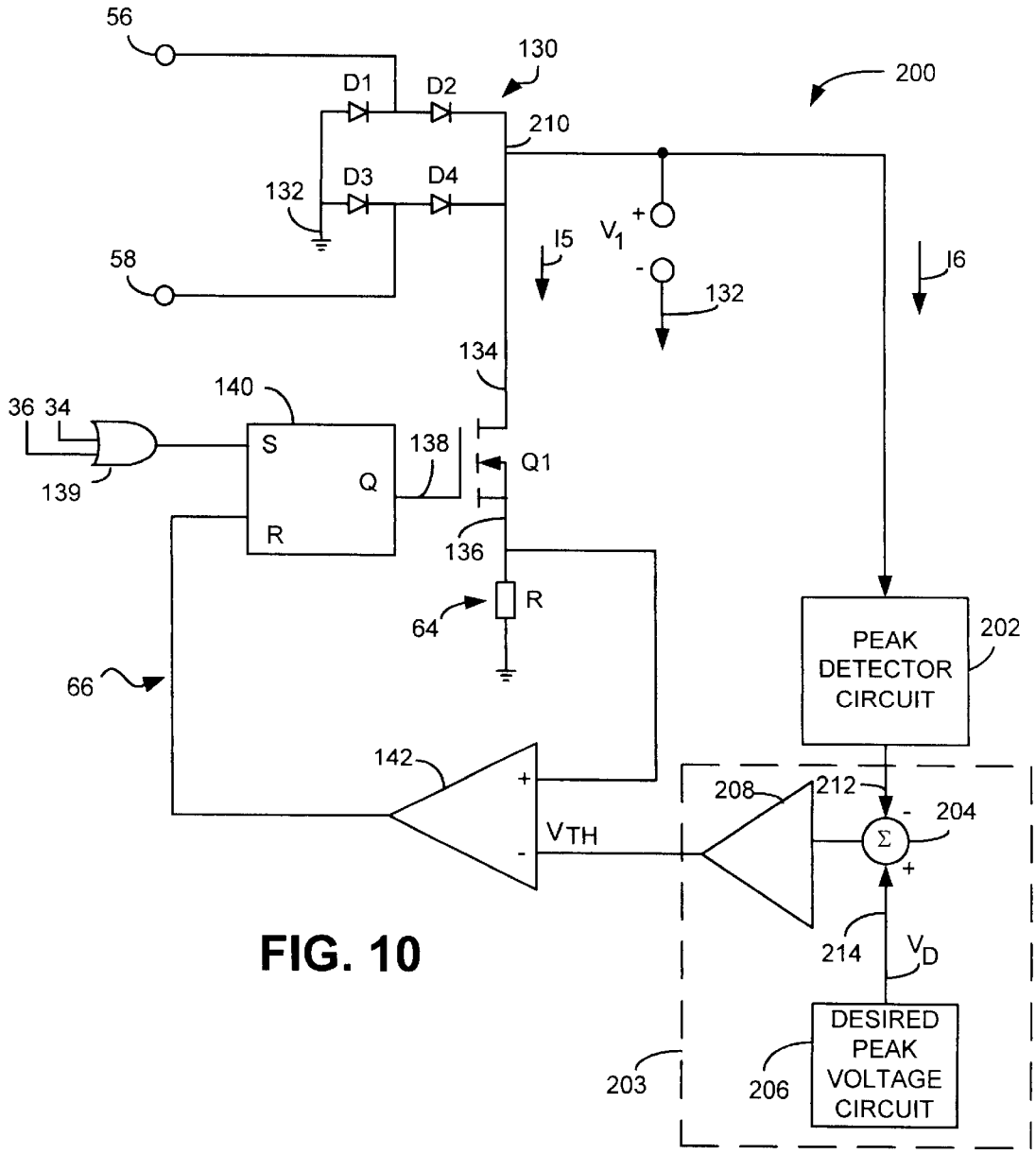
FIG. 10 is a diagram showing a resonant flyback ignitor circuit having an adaptive threshold according to an alternative embodiment of the present invention.

FIG. 10 is a block diagram of an ignitor circuit 200 in which the threshold voltage $V_{TH}$ is adaptively updated as a function of the peak voltage and current applied to ignitor inputs 56 and 58 when transistor Q1 is turned off. These peak values are directly proportional to the striking voltage that is applied to the lamp. The same reference numerals are used in FIG. 10 as were used in FIG. 9 for the same or similar elements.

Ignitor 200 is similar to ignitor 28 but further includes peak detector circuit 202 and adjustment circuit 203. Adjustment circuit 203 includes summing amplifier 204, desired peak voltage circuit 206 and compensated error amplifier 208. Peak detector circuit 202 is coupled between node 210 of bridge rectifier 131 and inverting input 212 of error amplifier 204. When transistor Q1 is turned off, peak detector circuit 204 samples voltage $V_1$ which is directly proportional to the magnitude of the striking voltage.

Peak detector circuit 202 measures the peak voltage during each half cycle. The measured peak voltage "leaks down" after each half cycle so a new peak voltage can be measured during the next half cycle. The measured peak voltage is applied to inverting input 212 of summing amplifier 204 and compared to a desired peak voltage VD provided by desired peak voltage circuit 206 to non-inverting input 214. The difference between the measured peak voltage and the desired peak voltage is applied as an error signal to the input of compensated error amplifier 208. Amplifier 208 generates threshold voltage $V_{TH}$ as a compensated error signal. Amplifier 208 can include proportional, integral and/or derivative paths for implementing a desired control function. The compensated $V_{TH}$ is applied to the inverting input of comparator 142.

With the feedback provided through peak detector circuit 202, the threshold voltage $V_{TH}$ is adaptively updated to adjust the flyback voltage pulse in applications having different load characteristics so that the peak striking voltage actually applied to lamp 14 is the same. Ignitor 200 therefore provides a reliable striking voltage to lamp 14 on each half cycle of the AC drive signal to achieve reliable and consistent ignition of lamp 14.

In alternative embodiments, peak detector circuit 202 and adjustment circuit 203 can include analog components, digital components, a combination of analog and digital components or can implemented in a programmed computer. Peak detector 202 can alternatively measure the actual striking voltage, rather than the sample $V_1$ in the embodiment shown.

Although the present invention has been described with reference to preferred embodiments, workers skilled in the art will recognize that changes may be made in form and detail without departing from the spirit and scope of the invention. The term "coupled" can include various types of couplings, such a direct connection or a connection through one or more additional components. Digital control signals can be active high or active low, depending upon the particular convention adopted and the technology used.

What is claimed is:

1. A gas discharge lamp control circuit comprising:

a first and second alternating-current (AC) input terminals;

first and second lamp terminals;

a capacitor coupled in parallel across the first and second lamp terminals;

a transformer comprising a primary winding coupled in a first series loop with the first and second AC input terminals and a secondary winding coupled in a second series loop with the first and second lamp terminals, wherein the secondary winding comprises a plurality of turns;

an inductance coupled within the first series loop; and an ignitor circuit having first and second ignitor inputs which are coupled across at least a portion of the plurality of turns of the secondary winding, and adapted to provide a temporary current path between the first and second ignitor inputs.

2. The gas discharge lamp control circuit of claim 1 wherein the inductance comprises an inductor winding which is coupled in series with the primary winding.

3. The gas discharge lamp control circuit of claim 1 wherein the inductance is a primary winding-referred leakage inductance of the transformer.

4. The gas discharge lamp control circuit of claim 1 wherein the first and second ignitor inputs are coupled across the entire secondary winding.

5. The gas discharge lamp control circuit of claim 1 wherein the secondary winding comprises first and second sets of turns which are coupled together in series and the ignitor circuit first and second ignitor inputs are coupled across only the first set of turns of the secondary winding.

6. The gas discharge lamp control circuit of claim 1 wherein the ignitor circuit comprises:

an ignitor switch having a control terminal;

a current sensor coupled in series with the ignitor switch between the first and second ignitor inputs; and a switch control circuit coupled between the current sensor and the control terminal of the ignitor switch.

7. The gas discharge lamp control circuit of claim 6 and further comprising a bridge rectifier coupled between the first and second ignitor inputs and coupled to the ignitor switch and the current sensor such that current received through the first and second ignitor inputs flows through the ignitor switch in only one direction.

8. The gas discharge lamp control circuit of claim 6 wherein the switch control circuit further comprises:

a trigger circuit coupled to the control terminal for selectively switching the ignitor switch from an open state to a closed state until the current sensor senses that a current flowing through the ignitor switch reaches a threshold level;

a peak detector circuit which measures a representation of a peak voltage generated across the first and second ignitor inputs when the trigger circuit switches the ignitor switch from the closed state to the open state; and an adjustment circuit which compares the measured representation of the peak voltage to a representation of a selected peak voltage and responsively adjusts the threshold voltage.

9. The gas discharge lamp control circuit of claim 6 wherein the switch control circuit selectively switches the ignitor switch from an open state to a closed state until the current sensor senses that a current flowing through the ignitor switch reaches a threshold level.

10. The gas discharge lamp control circuit of claim 9 wherein the switch control circuit comprises:

a set-reset flip-flop having a set input for receiving a trigger signal, a reset input coupled to a comparator output, and a trigger output coupled to the control terminal;

a comparator having a non-inverting input, an inverting input and the comparator output, wherein the non-inverting input is coupled to the current sensor; and a reference circuit coupled to the inverting input for providing a signal to the comparator which is representative of the threshold level.

11. A method of igniting a gas discharge lamp, the method comprising:

receiving an AC drive signal through first and second AC inputs;

applying the AC drive signal to a primary winding of a transformer through an inductance;

applying a voltage produced on a secondary side of the transformer in response to the AC drive signal across the gas discharge lamp;

shorting a plurality of turns in the secondary side of the transformer to store energy from the AC drive signal in the inductance; and un-shorting the plurality of turns to generate a flyback voltage in the inductance in response to the energy stored in the inductance from the step of shorting.

12. A gas discharge lamp control circuit comprising:

first and second AC inputs for receiving an AC drive signal;

first and second lamp terminals for coupling to a gas discharge lamp;

a capacitor coupled in parallel across the first and second lamp terminals;

a transformer comprising a primary winding coupled in a first series loop with the first and second AC inputs and a secondary winding coupled in a second series loop with the first and second lamp terminals, wherein the secondary winding comprises a plurality of turns;

an inductance coupled in the first series loop; and means for temporarily shorting and then un-shorting at least a portion of the plurality of turns of the secondary winding to generate a flyback voltage in the inductance.

13. A gas discharge lamp control circuit comprising:

a series circuit formed by first and second alternating-current (AC) input terminals, an inductance and first and second lamp terminals; and an ignitor circuit which is coupled to the series circuit and selectively couples and decouples at least a portion of the inductance in parallel with the first and second AC input terminals, wherein the ignitor circuit comprises:

first and second ignitor inputs which are coupled to the series circuit;

an ignitor switch having a control terminal;

a current sensor coupled in series with the ignitor switch between the first and second ignitor inputs; and a switch control circuit coupled between the current sensor and the control terminal of the ignitor switch and comprising a comparator having a first compare input coupled to the current sensor and a second compare input coupled to a reference input indicative of a reference current level through the ignitor circuit.

* * * * *

UNITED STATES PATENT AND TRADEMARK OFFICE

CERTIFICATE OF CORRECTION

PATENT NO. : 6,323,603 B1 
DATED : November 27, 2001
INVENTOR(S) : Eric G. Persson It is certified that error appears in the above-identified patent and that said Letters Patent is hereby corrected as shown below:

Title page,
Item [56], References Cited, OTHER PUBLICATIONS, please add:

-- "Control of Line-Frequency Controlled Rectifiers and Inverters," N. Mohan, T.M. Undeland, W.P. Robbins, Power Electronics: Converters, Applications, and Design, Copyright 1989 by John Wiley & Sons, Inc., pp. 42-45.

"Single-Phase Full-Wave Controller," S.B. Dewan, A. Straughen, Power Semiconductor Circuits, Copyright 1979 by John Wiley & Sons, Inc., pp. 160-161.

"Silicon Controlled Rectifiers," B.D. Wedlock, J.K. Roberge, Electronic Components and Measurements, Copyright 1969 by Prentice-Hall, Inc., Englewood Cliffs, NJ, pp.329-332. --

Column 10,
Line 21, delete "a".
Line 35, after "winding," add -- in parallel with the capacitor --.
Line 37, after "inputs", add -- in parallel with the capacitor --.

Signed and Sealed this

Twenty-second Day of April, 2003

JAMES E. ROGAN
*Director of the United States Patent and Trademark Office*